US010724468B2

(12) United States Patent
Fukui et al.

(10) Patent No.: US 10,724,468 B2
(45) Date of Patent: Jul. 28, 2020

(54) ENGINE

(71) Applicant: SUZUKI MOTOR CORPORATION, Hamamatsu-shi, Shizuoka (JP)

(72) Inventors: Daisuke Fukui, Hamamatsu (JP); Shimpei Sakka, Hamamatsu (JP)

(73) Assignee: SUZUKI MOTOR CORPORATION, Hamamatsu-Shi (JP)

( * ) Notice: Subject to any disclaimer, the term of this patent is extended or adjusted under 35 U.S.C. 154(b) by 0 days.

(21) Appl. No.: 16/415,620

(22) Filed: May 17, 2019

(65) Prior Publication Data

US 2019/0360429 A1 Nov. 28, 2019

(30) Foreign Application Priority Data

May 25, 2018 (JP) ..... 2018-100383

(51) Int. Cl.

| | |
|---|---|
| ***F02F 7/00*** | (2006.01) |
| ***F02B 75/16*** | (2006.01) |
| ***F02F 1/00*** | (2006.01) |
| ***F01M 11/02*** | (2006.01) |
| ***F01M 11/00*** | (2006.01) |
| ***F01M 11/06*** | (2006.01) |

(52) U.S. Cl.

CPC ..... *F02F 7/0004* (2013.01); *F01M 11/0004* (2013.01); *F01M 11/02* (2013.01); *F01M 11/061* (2013.01); *F02B 75/16* (2013.01); *F02F 1/004* (2013.01); *F02F 7/0053* (2013.01); *F02F 7/0058* (2013.01); *F01M 2011/0066* (2013.01)

(58) Field of Classification Search

CPC ..... F02F 7/0004; F02F 7/0058; F02F 7/0053; F02F 1/004; F02B 75/16; F01M 11/02; F01M 11/0004; F01M 11/061; F01M 2011/0066

See application file for complete search history.

(56) References Cited

U.S. PATENT DOCUMENTS

| | | | | |
|---|---|---|---|---|
| 2,146,368 A * | 2/1939 | Dake | F02F 1/14 | 123/41.8 |
| 3,643,637 A * | 2/1972 | Strossner | F02F 1/10 | 123/41.72 |
| 4,570,587 A * | 2/1986 | Watanabe | F02B 61/00 | 123/193.6 |
| 4,790,273 A * | 12/1988 | Oguri | F01M 9/06 | 123/195 HC |
| 6,810,849 B1 * | 11/2004 | Hirsch | F01M 1/04 | 123/185.3 |

(Continued)

FOREIGN PATENT DOCUMENTS

JP 2010-59929 A 3/2010

*Primary Examiner* — Hung Q Nguyen
(74) *Attorney, Agent, or Firm* — Stein IP, LLC

(57) ABSTRACT

An engine includes a crankcase in which a crank chamber that houses a crankshaft is formed, a cylinder block that is attached to the crankcase, and a cylinder that is formed with a sliding surface with respect to a piston. The crankcase includes a partition wall that forms the crank chamber. A lower end of the cylinder protrudes into the crank chamber from a lower end of the cylinder block, and a communicating hole that connects inside and outside of the cylinder is formed on a side surface of the cylinder as viewed in an axial direction of the crankshaft. The partition wall is formed with an opening that is communicated with the communicating hole.

14 Claims, 5 Drawing Sheets

(56) References Cited

U.S. PATENT DOCUMENTS

| | | | | |
|---|---|---|---|---|
| 2008/0022981 | A1* | 1/2008 | Keyaki | F01M 13/04<br>123/574 |
| 2009/0020107 | A1* | 1/2009 | Ramella | F02B 75/34<br>123/65 R |

* cited by examiner

ENGINE

CROSS REFERENCE TO RELATED APPLICATIONS

This application is based on Japanese Patent Application (No. 2018-100383) filed on May 25, 2018, the contents of which are incorporated herein by way of reference.

BACKGROUND

The present invention relates to an engine.

An engine of a motorcycle in recent years is required to further reduce a size thereof, and it is considered to lower a position of a cylinder thereof to reduce an overall height of the engine. For example, in an engine described in Patent Document 1, an upper-and-lower split crankcase including an upper case and a lower case is employed. A portion of the upper case constitutes a cylinder block formed with a cylinder chamber in which a piston is capable of sliding, and a lower end portion of the cylinder block protrudes into a crank chamber. An oil pan that stores oil is attached to a lower end portion of the crankcase.

Patent Document 1: JP-A-2010-59929

SUMMARY

According to one advantageous aspect of the invention, there is provided an engine including:

a crankcase in which a crank chamber that houses a crankshaft is formed;

a cylinder block that is attached to the crankcase; and a cylinder that is formed with a sliding surface with respect to a piston, wherein the crankcase includes a partition wall that forms the crank chamber, a lower end of the cylinder protrudes into the crank chamber from a lower end of the cylinder block, and a communicating hole that connects inside and outside of the cylinder is formed on a side surface of the cylinder as viewed in an axial direction of the crankshaft, and the partition wall is formed with an opening that is communicated with the communicating hole.

DETAILED DESCRIPTION OF EXEMPLIFIED EMBODIMENTS

When a position of a cylinder is lowered so that a lower portion thereof protrudes in the crankcase for a purpose of lowering an overall height of the engine, a distance between a lower end of the cylinder and an oil level in the oil pan becomes short. This increases an oil level variation due to movement of air on a back side of the piston when the piston moves down (pumping of the piston). As a result, there may be the following problems that: (1) the oil cannot be drawn and a lubrication failure occurs; (2) a crankshaft becomes resistance to stir the oil and friction loss increases, which results in reduced output and deteriorating fuel economy; and (3) the crankshaft stirs the oil, which causes the air to be mixed with the oil (aeration) and a predetermined lubricating performance cannot be exhibited.

The present invention is made in view of the foregoing, and an object thereof is to provide an engine capable of preventing an oil level fluctuation due to pumping of a piston.

Hereinafter, embodiments of the present invention are described in detail with reference to the accompanying drawings. Although examples are described in which the present invention is applied to an engine of a motorcycle, an application subject of the present invention is not limited thereto and changes can be made. For example, the present invention may also be applied to a buggy vehicle and other types of vehicles (saddled vehicles). In terms of directions, an arrow FR indicates a vehicle front side (vehicle travelling direction), an arrow RE indicates a vehicle rear side, an arrow UP indicates a vehicle upper side, an arrow LO indicates a vehicle lower side, an arrow L indicates a vehicle left side, and an arrow R indicates a vehicle right side, respectively. In the following drawings, a portion of configurations are omitted for convenience of illustration.

Figure 1:
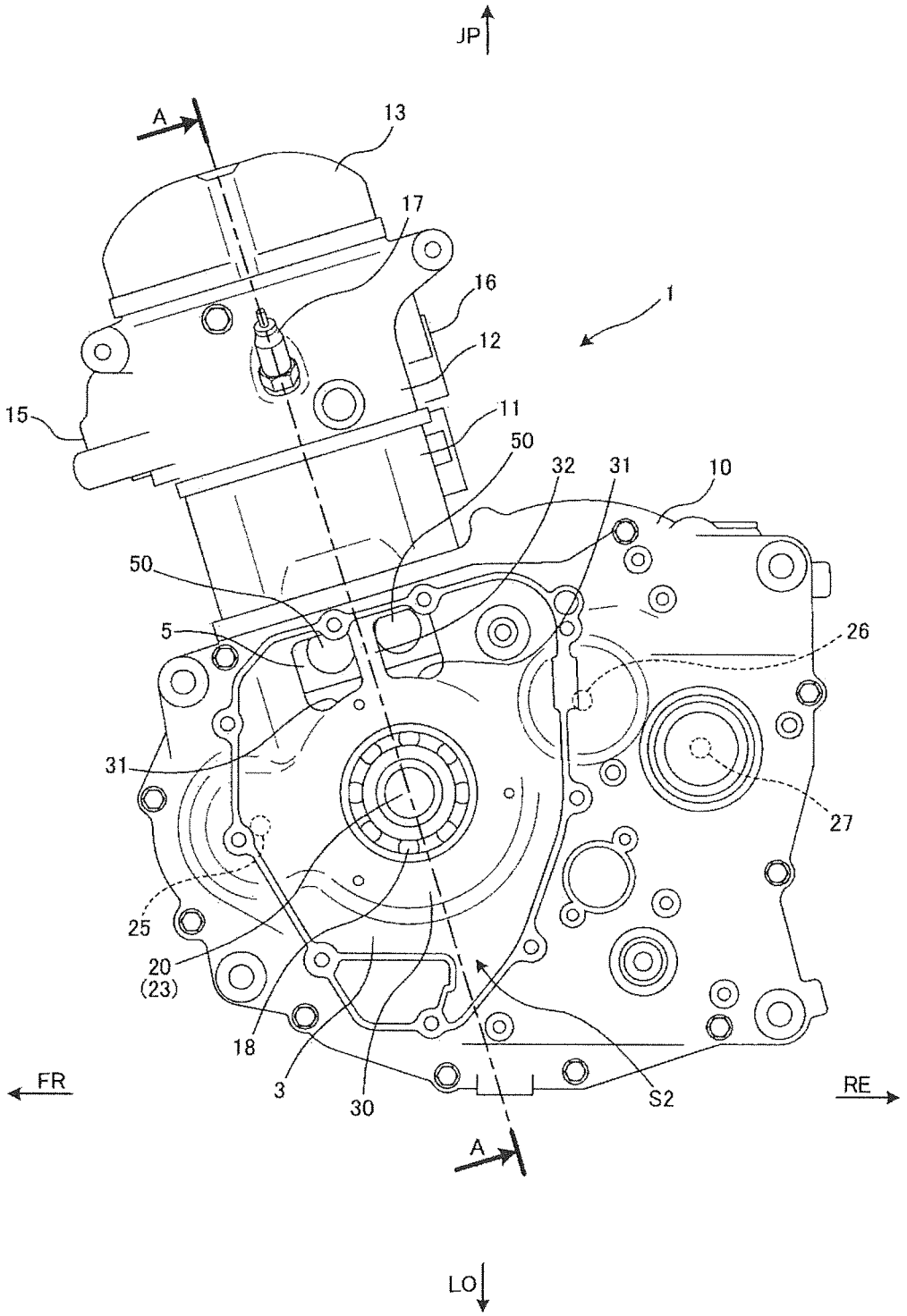
FIG. 1 is a left side view of an engine according to an embodiment.
Figure 2:
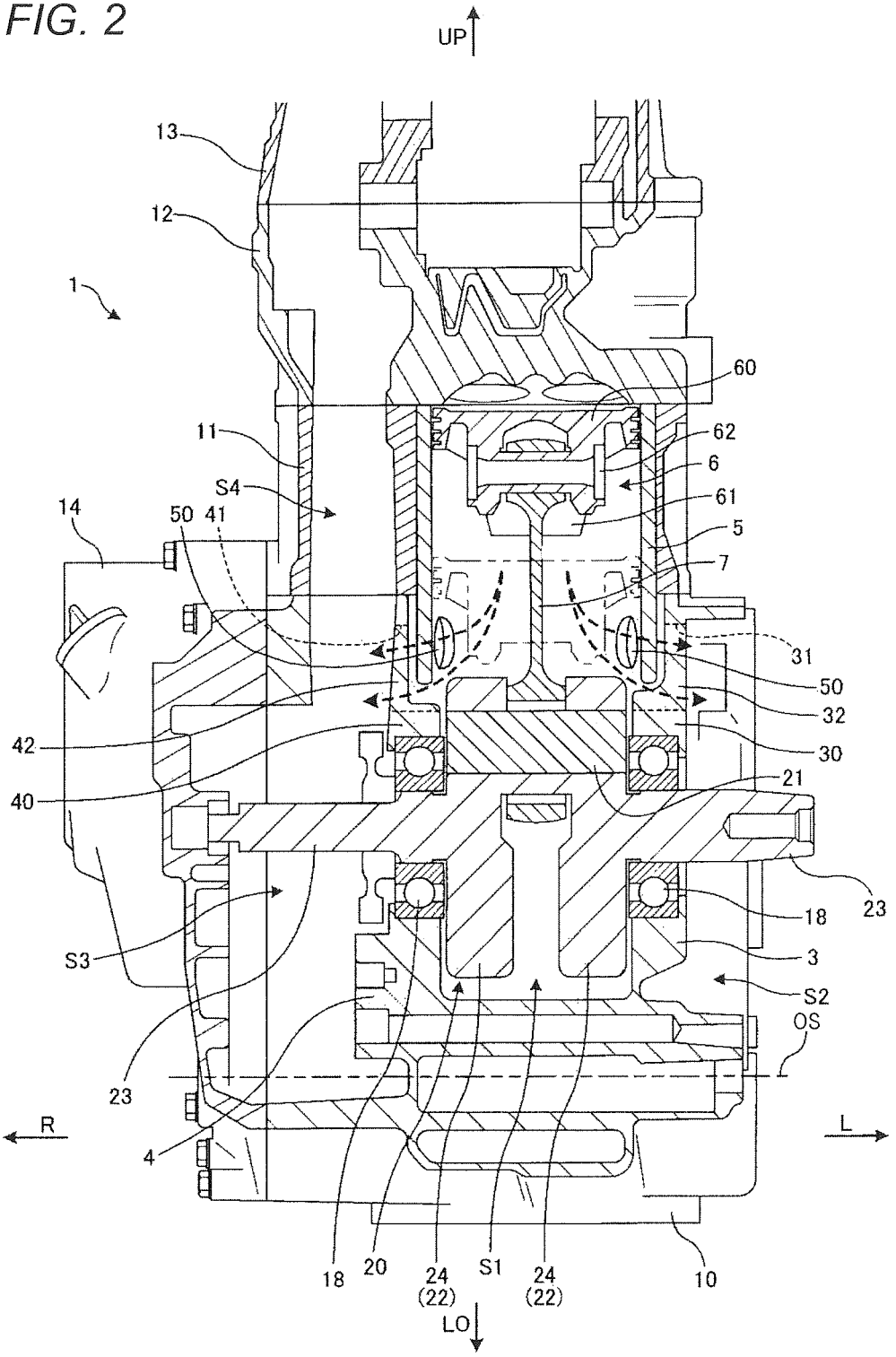
FIG. 2 is a cross-sectional view of the engine in FIG. 1 taken along a line A-A.

First, a schematic configuration of an engine according to an embodiment is described with reference to FIGS. 1 and 2. FIG. 1 is a left side view of an engine according to an embodiment. FIG. 2 is a cross-sectional view of the engine in FIG. 1 taken along a line A-A.

As illustrated in FIGS. 1 and 2, an engine 1 according to the present embodiment is a single-cylinder engine, and includes a crankcase 10, a cylinder block 11 attached to an upper portion of the crankcase 10, a cylinder head 12 attached to an upper portion of the cylinder block 11, and a cylinder head cover 13 attached to an upper portion of the cylinder head 12.

The crankcase 10 is constituted by a left-and-right split case, and is formed with a crank chamber S1 that accommodates various shafts such as a crankshaft 20. The crankshaft 20 includes a center shaft (rotation shaft) in a vehicle width direction (left-and-right direction). Specifically, the crankshaft 20 includes a crank pin 21, a pair of left and right crank webs 22 provided on both sides of the crank pin 21, and a pair of right and left main journals 23 protruding laterally from the crank webs 22 in a position eccentric from the crank pin 21. The crank webs 22 are integrally formed with a weight portion 24 protruding toward a side opposite to the crank pin 21 with respect to the main journals 23.

The left and right main journals 23 are coaxial and constitute the rotation shaft of the crankshaft 20. The main journals 23 are supported by bearing portions 30, 40 formed in a partition wall described below via a bearing 18. Although not particularly illustrated, a magnet is provided at an end portion of the left main journal 23, and a primary drive gear is provided at an end portion of the right main journal 23.

A balancer shaft 25 is disposed in front of the crankshaft 20. The balancer shaft 25 is provided with a balancer (not illustrated). A countershaft 26 is disposed on a rear upper side of the crankshaft 20. The countershaft 26 is provided with a clutch and various transmission gears (not illustrated), and the clutch is provided at a right end thereof. A drive shaft 27 is provided below the countershaft 26. The drive shaft 27 is provided with various transmission gears (not illustrated). Combinations of the gears of the countershaft 26 and the gears of the drive shaft 27 are switched, so that gearshift becomes possible.

The crank chamber S1 is formed by a plurality of partition walls. Specifically, the partition walls include a first partition wall 3 that divides the crank chamber S1 and a magnet chamber S2 on a left side of the crankcase 10, and a second partition wall 4 that divides the crank chamber S1 and a clutch chamber S3 on a right side of the crankcase 10. Lower space of the crank chamber S1 forms an oil chamber (oil pan) that stores a predetermined amount of oil.

The magnet is housed in the magnet chamber S2 formed on a left side of the first partition wall 3, and the magnet chamber S2 is blocked by a magnetic cover (not illustrated) attached to the left side of the crankcase 10. A primary drive gear is housed in the clutch chamber S3 formed on a right side of the second partition wall 4, and the clutch chamber S3 is blocked by a clutch cover 14 attached to the right side of the crankcase 10.

The cylinder block 11 includes a cylinder 5 formed with a sliding surface with respect to the piston 6. The cylinder 5 is separated from the cylinder block 11. The cylinder 5 is a spiny sleeve formed with numerous irregularities on an outer peripheral surface, so that adhesion to the cylinder block 11 is improved.

An axis of the cylinder 5 is inclined slightly forward with respect to a vertical direction, and the piston 6 is housed along the axis in a reciprocating manner. The piston 6 and the crankshaft 20 (the crank pin 21) are connected by a connecting rod 7. The reciprocation of the piston 6 is converted into rotation of the crankshaft 20. A lower end of the cylinder 5 enters the crank chamber S1, and the bearing portions 30, 40 are located directly below the crank chamber S1.

The piston 6 is integrally formed of a crown portion 60 having a thin cylindrical shape, a pair of skirt portions 61 extending downward from the crown portion 60 and a pin boss portion 62. Upper space of the crown portion 60 forms a combustion chamber. The pair of skirt portions 61 has an arc surface along an outer peripheral surface of the crown portion 60 and faces each other in an intake-exhaust direction (front-and-rear direction). The skirt portions 61 can maintain a posture of the piston 6 in the front-and-rear direction when the piston 6 moves up and down. An upper end of the connecting rod 7 is coupled to the pin boss portion 62.

The cylinder head 12 is formed with an exhaust port 15 on a front surface and with an intake port 16 on a rear surface. A lower surface of the cylinder head 12 and uppers surface of the cylinder 5 and the piston 6 form the combustion chamber. An ignition plug 17 protruding into the combustion chamber is attached to a left side surface of the cylinder head 12. The cylinder head 12 houses a valve mechanism (not illustrated) therein, which is disposed directly above the cylinder 5. The valve mechanism is covered by the cylinder head cover 13.

Further, a space defined on a right side of the cylinder 5, which is in the cylinder block 11, the cylinder head 12, and the cylinder head cover 13, forms a cam chain chamber S4 that accommodates a cam chain (not illustrated). The cam chain chamber S4 extends upward and downward so as to connect the crankcase 10 and the cylinder head cover 13. That is, the cam chain chamber S4 is connected to the clutch chamber S3 at a lower side.

It is assumed in an engine of a motorcycle that, as a piston moves up and down, air in a cylinder flows into a crank chamber, which causes an oil level in an oil pan located in a lower side of the crank chamber to be disturbed. This may lead to a situation in which oil cannot be appropriately drawn from an oil intake (oil strainer) provided in the oil pan. Such a phenomenon is particularly remarkably expressed in a single-cylinder engine.

For example, phases of pistons in a multi-cylinder engine shift separately, and accordingly there is piston that moves up at the same time when a piston of a certain cylinder moves down. Therefore, there is space into which air on a back side of the moving-down piston can flow, and an increase in pressure on a back surface of the piston is alleviated. Therefore, it is considered that the above phenomenon is less likely to occur in the multi-cylinder engine. In contrast, since there is no such space in the single-cylinder engine, pressure on a back surface of the piston increases. As a result, an oil level variation as described above is likely to occur. Further, even in the single-cylinder engine, the oil level variation and pumping loss may be further increased in a type of an engine in which a lower end of a cylinder protrudes into a crank chamber.

Figure 6:
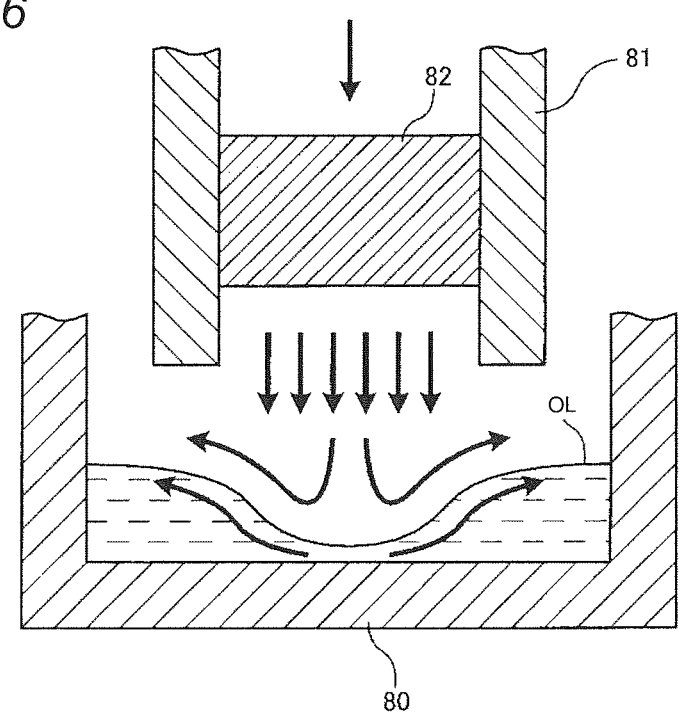
FIG. 6 is a schematic cross-sectional view of an engine according to a comparative example.

Here, the phenomenon described above is described with reference to FIG. 6. FIG. 6 is a schematic cross-sectional view of an engine according to a comparative example. In FIG. 6, only a crankcase 80, a cylinder 81, and a piston 82 are illustrated, and other configurations are omitted for convenience of illustration. As illustrated in FIG. 6, as the piston 82 moves down, air existing below the cylinder 81 is pushed toward the crankcase 80 below. Oil OL is stored in a bottom portion of the crankcase 80 to a predetermined height.

However, when the air pushed by the piston 82 flows toward a bottom side of the crankcase 80, the oil OL directly below the piston 82 that has nowhere to go is pushed toward a radial outer side of the cylinder 81. As a result, an oil level having a predetermined height is not ensured directly below the piston 82, an oil strainer (not illustrated) draws air instead of oil, and the oil is not supplied appropriately.

Therefore, for example, it is considered to form a hole in a partition wall forming a crank chamber so that air during pumping may be discharged from the hole to outside of the crank chamber. However, with reduction in a size of an engine in recent years, a lower end of the cylinder enters the crank chamber to a deep position, thereby blocking the hole in the partition wall. As a result, it is assumed that it is difficult to discharge air from the hole.

Therefore, the present inventors focused on a relationship between insertion depth into the crank chamber of the cylinder and a position of the hole formed in the partition wall of the crank chamber and conceived of the present invention. Specifically, the lower end of the cylinder 5 according to the present embodiment enters the crank chamber S1. That is, the lower end of the cylinder 5 protrudes into the crank chamber S1 from a lower end of the cylinder block 11. A side surface of the cylinder 5 is formed with a through hole 50 as viewed in an axial direction of the crankshaft 20. The through hole 50 serves as a communicating hole to connect inside and outside of the cylinder 5. Further, the partition walls (the first partition wall 3 and the second partition wall 4) are also fainted with openings 31, 41 corresponding to the through hole 50, respectively, so that at least a portion of the through hole 50 overlaps at least a portion of the openings 31, 41. The openings 31, 41 are communicated with the through hole 50.

According to these configurations, an overall height of the engine 1 can be reduced by causing the lower end of the cylinder 5 to enter the crank chamber S1. In this case, it is considered that resistance of air accompanying the up-and-down movement (pumping) of the piston increases. However, since the through hole 50 is formed in the side surface of the cylinder 5 so as to overlap the openings 31, 41 of the partition walls, the openings 31, 41 are not blocked so that a connection path to connect space in the cylinder 5 and the magnet chamber S2 and/or the clutch chamber S3 can be ensured.

As a result, pumping loss of the piston 6 is reduced. Specifically, air pushed to the lower side of the cylinder 5 by pumping the piston 6 is discharged to outside of the crank chamber S1 (the clutch chamber S3 or the magnet chamber S2) through the connection path (the through hole 50 and the openings 31, 41). Therefore, an oil level directly below the cylinder 5 is not roughened, and the oil can be supplied appropriately. That is, it is possible to prevent an oil level variation due to the pumping of the piston 6 and to reduce the size of the engine 1.

Figure 3:
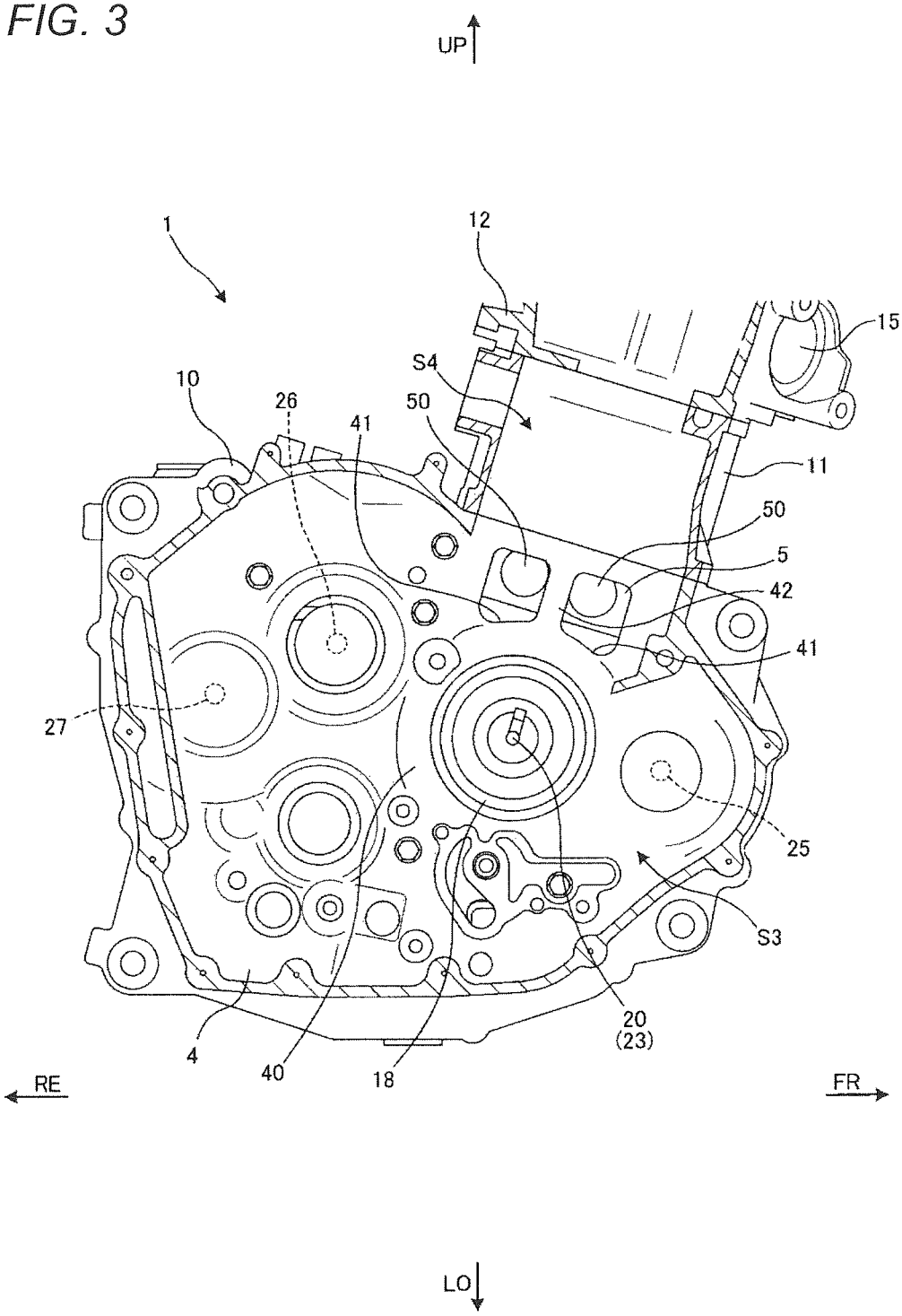
FIG. 3 is a cross-sectional view of the engine in FIG. 1, in which a cam chain chamber and a clutch chamber are cut into left and right.
Figure 4:
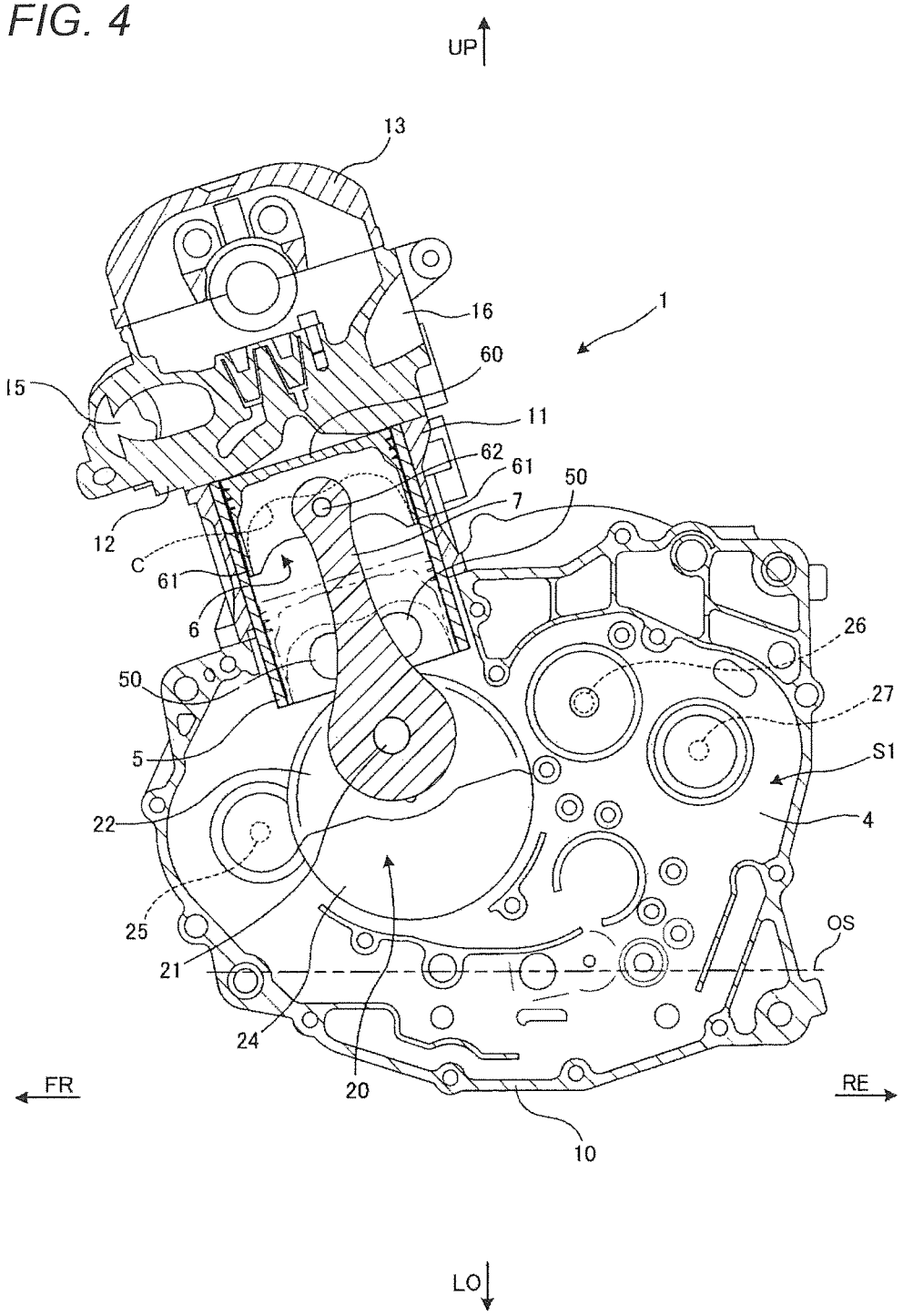
FIG. 4 is a cross-sectional view of the engine in FIG. 1 taken along a vertical plane including a central axis of a cylinder.

Next, an internal structure of the engine according to the present embodiment, particularly the connection path described above, is described with reference to FIGS. 1 to 4. FIG. 3 is a cross-sectional view of the engine in FIG. 1, in which a cam chain chamber and a clutch chamber are cut into left and right. FIG. 4 is a cross-sectional view of the engine in FIG. 1 taken along a vertical plane including a central axis of a cylinder. In FIGS. 2 and 4, a piston indicated by a solid line indicates a state at a top dead center, and a piston indicated by a two-dot chain line indicates a state at a bottom dead center.

As illustrated in FIGS. 1 to 4, the first partition wall 3 includes the ring-like bearing portion 30 centered on the crankshaft 20 (main journal 23) in a side view (see, in particular, FIG. 1). The bearing 18 is attached to the bearing portion 30 from inside. Similarly, the second partition wall 4 includes the ring-like bearing portion 40 centered on the crankshaft 20 (main journal 23) in a side view (see, in particular, FIG. 3). The bearing 18 is attached to the bearing portion 40 from inside.

The lower end of the cylinder 5 enters the crank chamber S1 as far as the bearing portions 30, 40. Specifically, the lower end of the cylinder 5 enters the crank chamber S1 as far as a position directly above the bearing portions 30, 40, where a small gap is formed between upper ends of the bearing portions 30, 40 and the lower end of the cylinder 5. Accordingly, the lower end of the cylinder 5 can be brought close to the bearing portions 30, 40 as much as possible, so that the overall height of the engine 1 can be reduced.

Further, the lower end of the cylinder 5 enters the crank chamber S1 by substantially the same height as an outer edge part of the crank webs 22. At least a part of the lower end of the cylinder 5 may overlap the crank webs 22 in an axial direction of the cylinder 5. In this case, the cylinder 5 can be disposed further downward, and the overall height of the engine 1 can be further reduced.

A plurality of through holes 50 penetrating the cylinder 5 in a thickness direction are formed on both side surfaces in the vehicle width direction (left-and-right direction) of the cylinder 5 that enters the crank chamber S1. Specifically, in a side view (FIG. 1 or 3), two through holes 50 are formed in a direction intersecting with the axial direction of the cylinder 5, for example, in a circumferential direction of the cylinder 5.

The openings 31, 41 corresponding to the through holes 50 are formed in the first partition wall 3 and the second partition wall 4, respectively. Column portions 32, 42 that divide the openings 31, 41 respectively into two are formed in the partition walls. Specifically, the openings 31, 41 are divided respectively into two front and rear openings by the column portions 32, 42 that extend upward and downward with respect to the adjacent two through holes 50. The column portions 32, 42 have such a front-and-rear width that the two through holes 50 are not blocked. Accordingly, rigidity of the partition walls can be ensured even if the openings 31, 41 are formed therein. The openings 31, 41 are larger than the through holes 50.

In this manner, since the through holes 50 are formed in the side surfaces of the cylinder 5 and the openings 31, 41 are respectively formed in the first partition wall 3 and the second partition wall 4 corresponding to the through holes 50, the connection path that connects the space in the cylinder 5 and the crank chamber S1 is formed. Accordingly, air moving down accompanying the pumping of the piston 6 flows into the magnet chamber S2 and the clutch chamber S3 from inside of the cylinder 5 through the connection path (the through holes 50 and the openings 31, 41) (see FIG. 2, in particular). For this reason, the air does not flow directly to the crankshaft 20 below the cylinder 5. Therefore, it is possible to prevent the oil level stored below the crankshaft 20 from being roughened by the flow of air. In FIGS. 2 and 4, a virtual line of the oil level is indicated by a chain line OS.

Further, lower ends of the openings 31, 41 are located below the lower end of the cylinder 5. Accordingly, the air can flow into the crank chamber S1 not only from the through hole 50 but also through the openings 31, 41 from below the cylinder 5. That is, a gap between the lower end of the cylinder 5 and a lower end of the openings 31, 41 can also be utilized as a connection path. As a result, the air can flow into the crank chamber S1 more effectively from the side surfaces of the cylinder 5.

While the through holes 50 are formed on both left and right sides of the piston 6, the skirt portions 61 that maintain the posture of the piston 6 are in contact with both front and rear side surfaces of the cylinder 5. That is, the skirt portions 61 are formed at a position that does not overlap the through holes 50 in the radial direction of the cylinder 5. In FIG. 4, an outer edge of the crown portion 60 located at left and right end portions of the piston 6 is indicated by dot line C. The outer edge of the crown portion 60 located at left and right end portions of the piston 6 does not overlap the through holes 50 at the bottom dead center of the piston 6. Therefore, the through holes 50 are not blocked by the piston 6 (crown portion 60) even when the piston 6 is located at the bottom dead center, so that discharge of the air is not impaired. Further, oil between the piston 6 and the cylinder 5 can be prevented from flowing out of the through holes 50, so that an increase in sliding resistance of the piston 6 can be prevented.

In the present embodiment as described above, the lower end of the cylinder 5 enters the crank chamber S1, and the through holes 50 are formed in the side surfaces of the cylinder 5 in the crank chamber S1. The openings 31, 41 are formed in the partition walls (the first partition wall 3 and the second partition wall 4) of the crankcase 10 corresponding to the through holes 50, so that the connection path that connects the space in the cylinder 5 and the magnet chamber S2 and/or the clutch chamber S3 is formed. Accordingly, it is possible to prevent the oil level variation due to the pumping of the piston 6 and to reduce the size of the engine 1.

Figure 5:
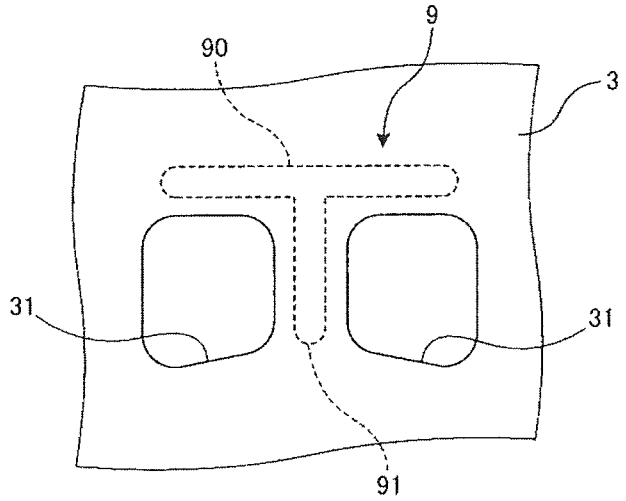
FIG. 5 is a schematic view illustrating an internal structure of an engine according to a second embodiment.

Next, a second embodiment is described with reference to FIG. 5. FIG. 5 is a schematic view illustrating an internal structure of an engine according to the second embodiment. In FIG. 5, the opening 31 formed in the first partition wall 3 is described as an example for convenience of illustration.

In the above embodiment, the openings 31, 41 are formed in the partition walls (the first partition wall 3 and the second partition wall 4), so that discharge of air via pumping of the piston 6 is improved. However, in the related art, an oil passage is formed in a partition wall, and it is accordingly assumed difficult to define a space that ensures the oil passage because of the openings 31, 41. Therefore, the second embodiment describes a structure in which an oil passage can be ensured even in a partition wall formed with the openings 31, 41.

As illustrated in FIG. 5, an oil passage 9 having a T shape in a side view is formed along an outer periphery of the opening 31 of the first partition wall 3. Specifically, the oil passage 9 includes a first passage 90 extending forward and rearward above upper portions of two openings, and a second passage 91 extending downward along the column portion 32 from middle of the first passage 90. Accordingly, the oil passage 9 can be ensured even if the opening 31 is formed in the first partition wall 3. The oil passage 9 may also be formed in the second partition wall 4.

In the above embodiments describe the single cylinder engine 1 as an example, but the present invention is not limited thereto. For example, the engine 1 may be constituted by a multi-cylinder engine having two or more cylinders, and arrangements of the cylinders may be appropriately changed.

In the above embodiments, the magnet chamber S2 is formed on the left side of the crank chamber S1, and the clutch chamber S3 is formed on the right side of the crank chamber S1, but the present invention is not limited thereto. The magnet chamber S2 and the clutch chamber S3 may be left-and-right reversed.

In the above embodiments, two through holes 50 and two openings 31, 41 are formed, but the present invention is not limited thereto. The number of the through holes 50 and the number of the openings 31, 41 may be one or three or more. Further, arrangement positions of the two or more through holes 50 and the openings 31, 41 are not limited to the front-and-rear, and may be up-and-lower.

The above embodiments describe the cylinder 5 constituted by a spiny sleeve separated from the cylinder block 11, but the present invention is not limited thereto. The cylinder 5 may be formed integrally with the cylinder block 11. The cylinder 5 is not limited to a spiny sleeve, and may be, for example, a cast iron sleeve.

The above embodiments describe the circular through holes 50 as an example as the connection path formed in the cylinder 5. When being formed of a sleeve separated from the cylinder block 11, the cylinder 5 is formed of a material having rigidity higher than that of the cylinder block 11. For this reason, it is necessary to consider durability of a processing tool when the through holes 50 are formed in the cylinder 5. Therefore, the through holes 50 are circular in the above embodiments, and are processed with a drill instead of an end mill. Hole processing with a drill is easy since the through holes 50 are simple circular holes, and a degree of wear of the tool can be reduced as compared with a case of hole processing with an end mill even if a material having relatively high rigidity is processed. Further, by forming a plurality of circular holes, it is possible to increase an opening area of the connection path and improve air discharge.

The above embodiments describe the circular through holes 50 as an example as the connection path formed in the cylinder 5, but the present invention is not limited thereto. When the cylinder 5 and the cylinder block 11 are integrally formed as described above, the connection path may be formed by a notch instead of the through holes 50.

In the above embodiments, the through holes 50 overlap at least a portion of the openings 31, 41, but the present invention is not limited thereto. The through holes 50 and the openings 31, 41 may be completely overlapped.

In the above embodiments, the openings 31, 41 are larger than the through holes 50, but the present invention is not limited thereto. The through holes 50 may be larger than the openings 31, 41.

In the above embodiments, an axial direction of the through holes 50 is preferably inclined downward toward an outer side (outer peripheral side) with respect to the thickness direction of the cylinder 5. In other words, the axial direction of the through holes 50 is preferably inclined downward toward an outer side in the radial direction of the cylinder 5. According to this configuration, it is possible to form a connection path inclined downward along the flow of air and obtain more effective air discharge.

A plurality of embodiments and modifications have been described, and the above embodiments and modifications may be combined in whole or in part as another embodiment of the present invention.

Embodiments of the present invention are not limited to the above embodiments, and changes, substitutions and modifications may be made without departing from the spirit of the technical concept of the present invention. The present invention may be implemented by use of other methods as long as the technical concept of the present invention can be implemented by the methods through advance of technology or other derivative technology. Therefore, the scope of claims covers all embodiments that may fall within the scope of the technical concept.

As described above, the present invention can prevent an oil level variation due to pumping of a piston, and is particularly useful for a single-cylinder engine of a motorcycle.

What is claimed is:

1. An engine comprising:

a crankcase in which a crank chamber that houses a crankshaft is formed;

a cylinder block that is attached to the crankcase; and a cylinder that is formed with a sliding surface with respect to a piston, wherein the crankcase includes a partition wall that forms the crank chamber, a lower end of the cylinder protrudes into the crank chamber from a lower end of the cylinder block, and a communicating hole that connects inside and outside of the cylinder is formed on a side surface of the cylinder as viewed in an axial direction of the crankshaft, and the partition wall is formed with an opening that is communicated with the communicating hole.

2. The engine according to claim 1, wherein the engine is configured by a single-cylinder engine.

3. The engine according to claim 1, wherein the partition wall includes a first partition wall that divides the crank chamber and a clutch chamber, and a second partition wall that divides the crank chamber and a magnet chamber, and the opening is formed in each of the first partition wall and the second partition wall.

4. The engine according to claim 1, wherein
the partition wall includes a bearing portion that supports the crankshaft,
the bearing portion is located directly below the cylinder, and
the lower end of the cylinder is provided in vicinity of the bearing portion.

5. The engine according to claim 1, wherein
at least a portion of the lower end of the cylinder overlaps the crankshaft in an axial direction of the cylinder.

6. The engine according to claim 1, wherein
the piston includes a skirt portion that contacts the sliding surface, and
the skirt portion does not overlap the communicating hole in a radial direction of the cylinder.

7. The engine according to claim 1, wherein
the cylinder is configured by a spiny sleeve.

8. The engine according to claim 1, wherein
the communicating hole is formed by a through hole penetrating the side surface of the cylinder in a thickness direction of the side surface of the cylinder.

9. The engine according to claim 8, wherein
an axial direction of the through hole is inclined downward toward an outer side in a radial direction of the cylinder.

10. The engine according to claim 8, wherein
at least two through holes penetrating the side surface in the thickness direction are formed so as to be arranged in a direction intersecting with the axial direction of the cylinder.

11. The engine according to claim 10, wherein
the partition wall includes a column portion that divides the opening into at least two corresponding to the through holes.

12. The engine according to claim 11, wherein
the column portion is formed with an oil passage.

13. The engine according to claim 1, wherein
the opening is larger than the through hole.

14. The engine according to claim 1, wherein
a lower end of the opening is located below the lower end of the cylinder.

* * * * *